US006092543A

United States Patent [19]

Roh

[11] Patent Number: 6,092,543

[45] Date of Patent: Jul. 25, 2000

[54] PROTECTIVE COVER FOR A BABY CARRIER WHICH PROVIDES SUN, INSECT, AND IMPACT PROTECTION

[76] Inventor: Warren E. Roh, 7753 S. Ames Way, Littleton, Colo. 80128

[21] Appl. No.: 09/040,764

[22] Filed: Mar. 18, 1998

[51] Int. Cl.[7] ..... E04H 15/02

[52] U.S. Cl. ..... 135/96; 224/160; 224/161

[58] Field of Search ..... 224/160, 161; 135/96

[56] References Cited

U.S. PATENT DOCUMENTS

| | | | |
|---|---|---|---|
| 598,995 | 2/1898 | Jacob . | |
| 1,940,224 | 12/1933 | Munro . | |
| 2,628,358 | 2/1953 | Neils . | |
| 3,799,414 | 3/1974 | Fiffer . | |
| 4,009,808 | 3/1977 | Sharp . | |
| 4,333,591 | 6/1982 | Case . | |
| 4,923,104 | 5/1990 | Rice | 224/160 |

*Primary Examiner*—Beth A. Aubrey
*Attorney, Agent, or Firm*—Thomas W Hanson

[57] ABSTRACT

A protective cover for a backpack style baby carrier which fully encloses the occupant of the carrier, providing protection from sun exposure, insects, rain, snow and light impacts such as from overhanging branches. The cover may be used while the carrier is being carried and while it is set on the ground. An integral pocket encloses the carrier's collapsible stand, providing for normal use of the stand. Baffled openings are provided for the carriers straps, preventing ingress by insects through the strap openings. Mesh panels are used throughout to provide ventilation while excluding insects.

37 Claims, 14 Drawing Sheets

PROTECTIVE COVER FOR A BABY CARRIER WHICH PROVIDES SUN, INSECT, AND IMPACT PROTECTION

FIELD OF THE INVENTION

This invention relates to protection covers for baby carriers and more specifically to such covers for backpack style baby carriers.

BACKGROUND OF THE INVENTION

The use of various types of apparatus for carrying a baby without the use of the parent's hands is well known. One of the more recent developments in this area is the backpack type of carrier. A seat is provided for the baby which is attached to a frame. The frame is fitted with straps and adapted to be carried on the back in a manner similar to a conventional backpack. These have enjoyed increasing popularity because of their convenience and the increased weight that can be carried and the time for which that weight can be carried. This type of baby carrier has made feasible extended walks and even off-road hiking while carrying a baby. It is becoming increasingly common for theses carriers to include a collapsible support stand which allows the carrier to be placed upright on the ground. This makes it possible to place the baby in the carrier and secure it while the stand is sitting upright; simplifies the process of donning the carrier; and allows the carrier to be used as a temporary seat.

As experience with the backpack form of baby carriers has accumulated, several problems have become apparent. Many of these problems are magnified for extended, off-road hikes. First, most carriers do not provide sun protection for the baby. The apparent assumption is that the baby's apparel will provide this protection.

Recent research has emphasized the importance of protecting babies and infants from sun exposure. Immediate effects of sunburn can include dehydration, fever, faintness, delirium, shock, dangerously low blood pressure, and irregular heart beat. Long term effects are also a serious concern. Early sun exposure increases the risk of skin cancer, wrinkles, and even cataracts in later life and the damage is cumulative, building with each sunburn or even each exposure. Research indicates that two or more blistering sunburns as a child or teen increases the risk of skin cancer later in life. These risks are compounded by the fact that baby's skin is thinner and will sunburn more easily than an adult's skin. Further, since babies can not communicate they can't tell a caregiver when they are getting too hot or beginning to sunburn. Where the baby is in a carrier on the caregiver's back, the caregiver may not notice the condition developing. Current recommendations include providing protective clothing including broad brimmed hats which shade the ears, nose, and lips; using sunscreen for babies over six months of age; and keeping babies under six months of age out of direct sunlight entirely. Protection is important even on overcast days, as damaging rays can penetrate light clouds and haze. See Sunproofing Your Baby, The Skin Cancer Foundation (1992); and Fun in the Sun: Keep Your Baby Safe, American Academy of Pediatrics (1995).

Second, no protection from insects is provided. This lack can become critical in natural settings where swarms of mosquitoes or flies, bees, hornets, ticks, or other stinging or biting insects may be encountered unexpectedly and avoidance is not an option.

Third, no protection from airborne debris is provided. Winds can pick up and propel leaves, needles, dirt, twigs and other debris with sufficient force to irritate or even injure an unprotected baby.

Fourth, backpack baby carriers are often designed to position the baby's head slightly above that of the adult carrying them. This provides them with an unrestricted view, and improves the weight distribution. However, this position also exposes the baby to the risk of possible impact with overhanging branches, rocks or other protrusions which the adult may not notice because they are above the adults head.

When the walking or hiking activity is taking place in warm or hot weather, it is also important that the baby be kept cool and that the carrier not overheat the adult who is carrying it.

One design for providing supplemental protection for a baby in a backpack style carrier is disclosed in U.S. Pat. No. 4,333,591 to Case. This is a foul weather cover for a carrier which is designed primarily to provide protection against wind and rain. The design is essentially a sack which encloses both the carrier and the baby, utilizing a drawstring to cinch the upper end around the baby, leaving the head exposed. Because the cover closes around the baby, chafing or irritation could result from the contact. Slits are provided in the cover through which the shoulder and waist straps of the carrier can pass when in use. The lower end of the sack is wider than the top, allowing for the carrier's stand to be extended. This can result in a significant amount of loose material bunching around the lower end of the carrier when the stand is collapsed. Pockets are provided on the rear of the cover to hold various articles needed for the care of the baby. Significantly, the cover disclosed in Case does not fully enclose the baby. A separate hood is used to protect the baby's head, leaving a gap at the neck. No protection for the baby's face is disclosed. This lack of full enclosure makes the cover ineffective in protecting against insects or airborne debris. The cover is also inappropriate for fair weather or hot weather use. The water proof fabric would quickly result in overheating of the baby if in place during hot weather and possibly even during mild, sunny weather. No impact protection for the baby's head is provided.

There is a need for a supplemental cover for a backpack style baby carrier which provides protection for the baby from exposure to the sun, insects, and flying debris while maximizing the ventilation available to the baby and to the person carrying it. The cover should provide full enclosure with no paths through which either a crawling or flying insect can penetrate to reach the baby. The cover should not come into contact with the baby when in normal use, to prevent chafing or irritation. Preferably this cover would also provide impact protection against overhanging hazards such as tree branches. The cover should not interfere with the normal operation of the carrier, including the use of the collapsible stand. Preferably the cover would include a repositionable sunshade to regulate the sun exposure, moveable as needed to block the direct sunlight.

SUMMARY OF THE INVENTION

The present invention is a protective cover for use with a baby carrier. the cover encloses both the carrier and the baby occupying the carrier, providing protection from sun exposure, insects, and light impacts. The cover consists of two main components which are attached together: the body cover and the head cover. The body cover generally encloses the bottom portion of the carrier up to the level of the top of the seat. The head cover encloses the baby from that point upward and includes opaque panels to shield the baby's head and shoulders from the sun. The two components are separable to allow the baby to be placed in the carrier, and to allow the cover to be placed around the carrier. After the baby is secured in the carrier, the head cover and the body cover are attached together. In the preferred embodiment a zipper is used to seal the two parts together, keeping out insects. Both the body cover and the head cover make use of mesh panels to provide ventilation while keeping out insects.

In an alternative embodiment, the body cover includes a separate, integral pocket which encloses a collapsible stand which is part of the carrier. This allows the stand to be extended or collapsed, providing full functionality, while keeping the carrier completely enclosed.

In another alternative embodiment, the head cover uses a flexible rod to hold the head cover up and away from the baby, to eliminate the irritation that can be caused by the cover rubbing against the baby.

In a still further embodiment, the cover is fully enclosing, providing no gaps through which an insect could fly or crawl to reach the baby. Baffled opening for the carriers straps are provided to block that path of entry.

In a still further embodiment, a removable sunshade is provided which can be attached to the cover where and when necessary to provide additional shade for one or more of the mesh panels. If desired, multiple sunshades could be added.

In a still further embodiment, a guard is added to the head cover to increase the impact protection provided by the cover.

The disclosed invention is a supplemental cover for a baby carrier which provides protection from sun exposure, insects, flying debris, and light impacts. The extensive use of mesh panels provides significant ventilation while strategic use of opaque panels provides the needed sun protection. In its preferred form, the cover fully encloses the carrier and the baby, blocking all access to the baby by either flying or crawling insects and can be used either while the carrier is resting on the ground or being carried. The cover does not interfere with the normal functioning of the carrier. Additional sunshade panels can be used to increase the amount of sun protection provided.

The above and other features and advantages of the present invention will become more clear from the detailed description of a specific illustrative embodiment thereof, presented below in conjunction with the accompanying drawings.

DESCRIPTION OF THE PREFERRED EMBODIMENT

The following discussion focuses on the preferred embodiment of the invention, wherein a fully enclosing cover, with mesh body and head enclosure, is used with a typical baby carrier. However, as will be recognized by those skilled in the art, the disclosed invention is applicable to a variety of such carriers and can be adapted to similar conveyances and still be within the scope of the invention.

The following is a brief glossary of terms used herein. The supplied definitions are applicable throughout this specification and the claims unless the term is clearly used in another manner.

Baby—generally the occupant of the backpack enclosed by the invention. Also includes infants of any age that can also be carried in such a device.

Baffle—an element which serves to block or impede entry. Specifically, such an element which resists the entry of insects into the cover.

Parent—used as a general term to describe the person carrying the baby backpack, even though that person could be any caregiver.

The disclosed invention is described below with reference to the accompanying figures in which like reference numbers designate like parts. Generally, numbers in the 100's refer to the baby carrier with which the invention is used, but is not itself part of the invention. Numbers in the 200's are used to refer to the occupant of the carrier or the person carrying it, or objects in the surrounding environment. Reference numbers in the 300's are used to refer to parts of the disclosed invention.

Typical Baby Carrier Backpack

Figure 1:
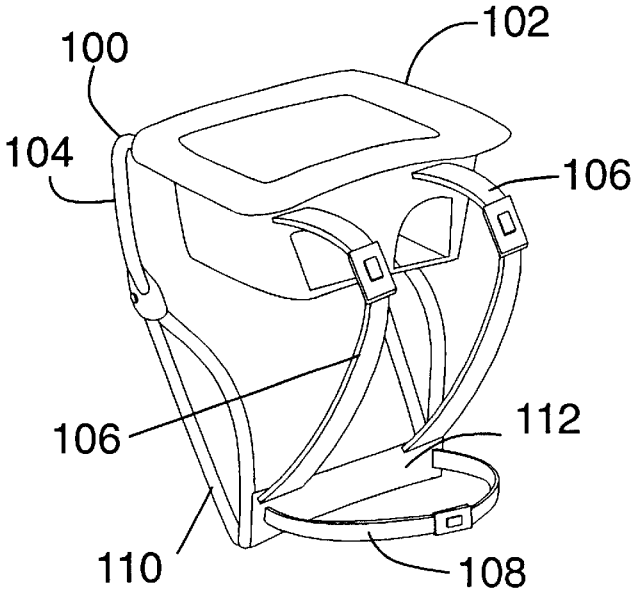
FIG. 1 illustrates a typical backpack style baby carrier with the support stand collapsed.
Figure 2:
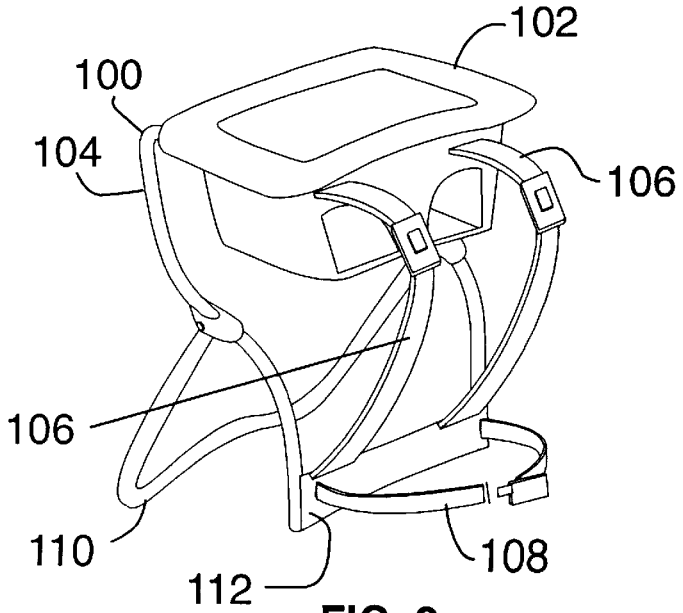
FIG. 2 illustrates a typical backpack style baby carrier with the support stand extended.

FIGS. 1 and 2 illustrate the structure of a typical baby carrier backpack, 100. The seat, 102, holds the baby in a generally upright, sitting position. Frame, 104, provides the structure of the backpack and interconnects the other components. Shoulder straps, 106, attach to the frame at the upper and lower ends and will encircle the parent's shoulders. Hip pad, 112, is designed to bear against the parent's hips and support much of the weight. Waist strap, 108, holds the hip pad in position and stabilizes the backpack. Stand, 110, can be deployed, as in FIG. 2, to allow the backpack to be set down in an upright position. When the backpack is being carried, the stand is folded away as in FIG. 1.

Figure 3:
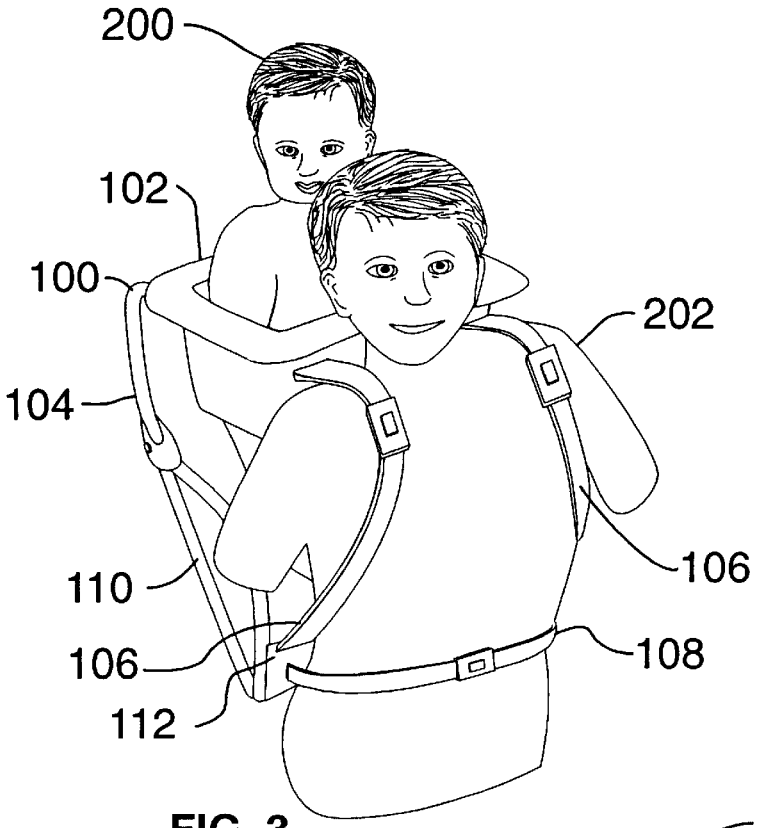
FIG. 3 illustrates a typical backpack style baby carrier being carried by an adult.

FIG. 3 illustrates the above baby backpack in use. The baby, 200, sits in seat, 102, facing forward. The parent, 202, utilizes the shoulder straps, 106, waist strap, 108, and hip pad, 112, to carry the baby backpack much like a conventional backpack. The baby is typically positioned with it's head slightly higher than the parent's both to provide visibility for the baby and for better weight distribution for the parent. As discussed above, the stand, 110, is collapsed to reduce the size of the carrier.

Figure 4:
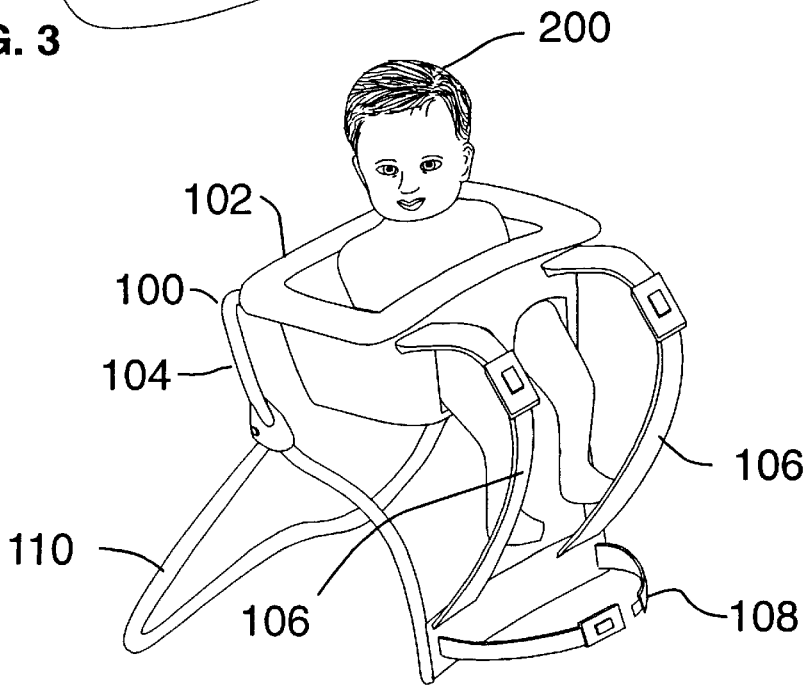
FIG. 4 illustrates a typical backpack style baby carrier supported by the collapsible stand.
Figure 5:
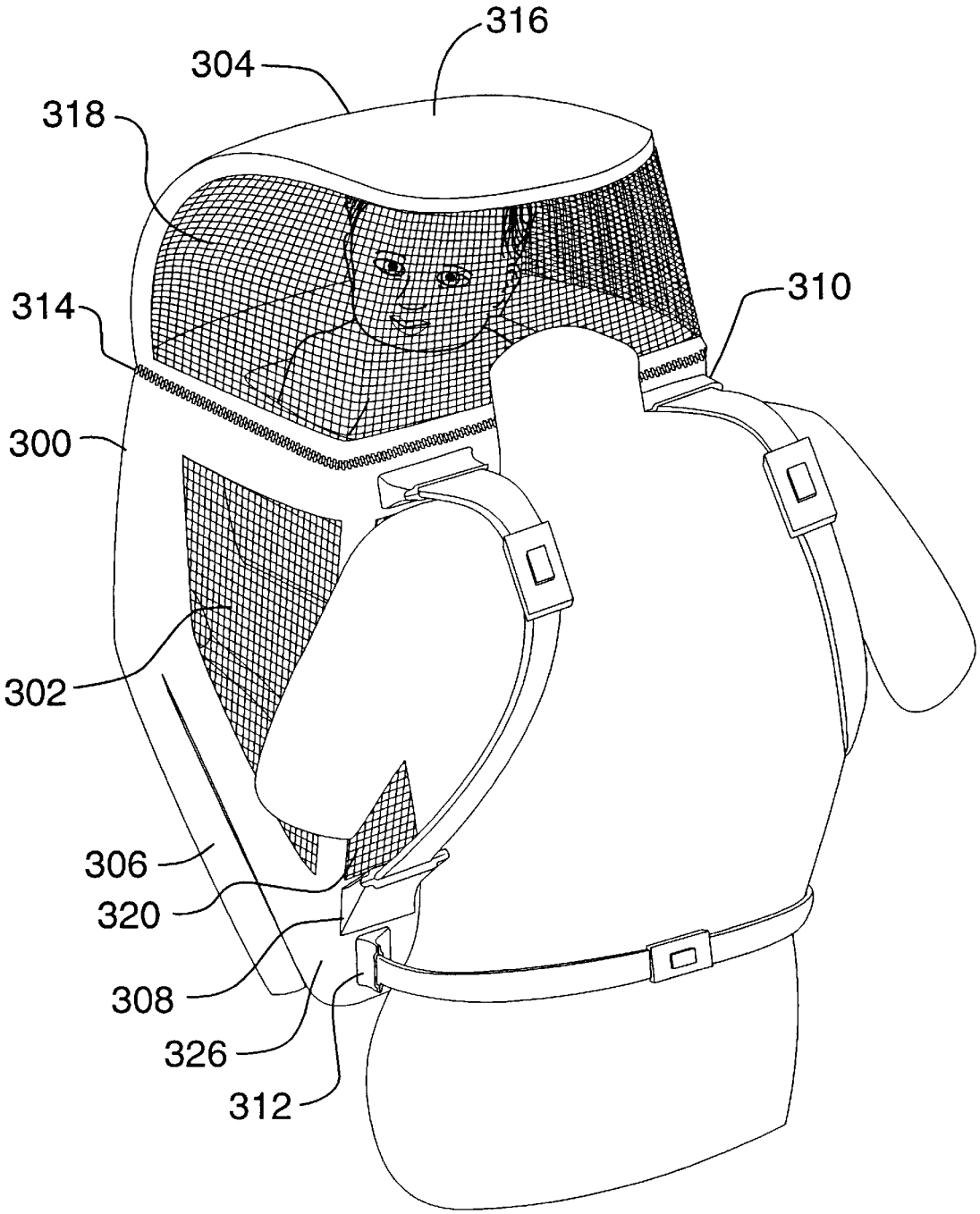
FIG. 5 shows the present inventive cover in place around a typical carrier being carried.

As FIG. 4 illustrates, the backpack can also be set down on a flat surface by extending the stand, 110. In this configuration the carrier can also serve as a temporary chair for the baby, 200. This is convenient on an extended hike where the parent may want to rest but does not want the bother of taking the baby out of the carrier. This is especially desirable where the baby is sleeping Features of the Preferred Embodiment The inventive baby backpack cover, 300, in use with a typical baby carrier backpack is shown in FIG. 5. The cover fully encloses the carrier and the baby without interfering with the normal functioning of the carrier. The majority of the carrier is comprised of fine mesh panels, 302, 320, and 318, to provide ventilation while excluding insects, dirt, leaves, and other debris. Panel, 320, also provides ventilation and cooling for the parent's back. An additional benefit to these mesh panels is that they are sufficiently sheer that the baby and the carrier can be seen through the mesh. This greatly simplifies the positioning of the baby in the carrier as compared to performing the same task with an opaque cover in place. A further benefit is that the mesh is sufficiently fine that it will deflect or diffuse light rainfall, or even snow, reducing the impact on the child. While the cover is not intended for rain protection, it will reduce the impact should an unexpected shower occur.

The head enclosure, 304, utilizes an opaque panel, 316, on the top and rear to provide protection from sun exposure. The mesh panel, 318, encloses the other three sides to provide panoramic view, significant ventilation, and protection. The head enclosure will keep out insects, leaves, dirt and other wind blown debris and provides protection for the baby from light impacts as with overhanging branches. The head enclosure is self-supporting and does not come into contact with the baby during normal use. This avoids chafing and other irritation to the baby caused by some prior art covers. This is especially important in hot or humid weather. Zipper, 314, detachably connects three sides of the head enclosure to the body of the cover. This provides an easily removed coupling which is impenetrable by insects. The rear side is sewn to the body of the cover. Where full protection is not needed, the head enclosure can be unzipped, folded back, and stored in a pocket on the read of the cover.

Strap openings, 308, 310, and 312, allow the backpack's straps to pass through the cover, and seal around the straps to block entry by insects. Pocket, 306, separately encloses the stand, 110. Because a separate pocket is used, there is no excess material to bunch up, or hang loose, and possibly catch on passing branches or other protrusions.

Figure 6:
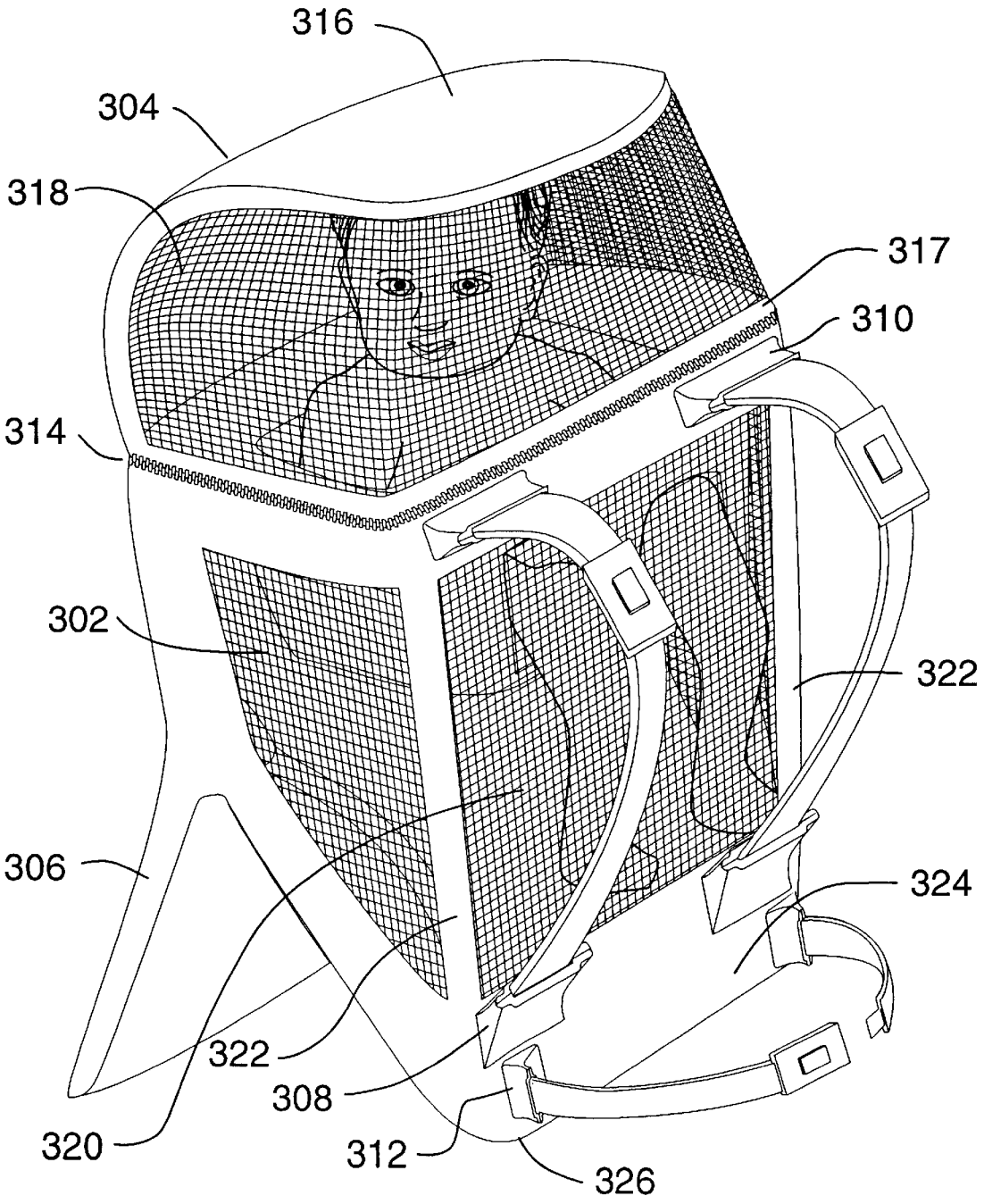
FIG. 6 shows the present inventive cover in place around a typical carrier supported by the collapsible stand.

The carrier can be taken off and set down with the cover in place, as shown in FIG. 6. Pocket, 306, allows the stand to be fully extended for optimal stability. Normally, in this position the baby would be exposed to crawling insects which could climb up the frame or the straps. However, with the cover in place, the child remains fully enclosed and protected from the sun, insects and other environmental hazards. Because the cover is fully enclosed, entry to even crawling insects is extremely difficult. Panel, 320, provides increased ventilation over what was available when the baby was being carried. Because the mesh panels are sheer, the baby can be viewed and monitored while still within the cover. The pocket, 306, and the lower portion of the body, 326, are constructed of a waterproof, breathable material. When the carrier is set down, these areas will not absorb moisture and will prevent dirt from entering the cover. The overall result is a baby who is shaded, cooled, undisturbed by insects or blowing debris but can still see out and be seen. This will likely make the experience more pleasant for both the baby and the parent.

Structure of the Preferred Embodiment

The disclosed cover serves primarily to provide protection for a baby in a backpack type carrier in fair weather or hot or humid weather. To this end, the design of the cover seeks to attain several goals. First among these is the exclusion of insects, whether flying or crawling, from the carrier. This is followed closely by the provision of maximum ventilation to keep the baby cool. Other goals include protection of the baby from exposure to the sun; protection from light impacts as from flying debris or overhanging branches; no required contact between the baby and the cover; and no interference with the normal operation of the carrier. Over riding all of these goals is the requirement that the cover be safe for both the baby and the parent. The design addresses these goals for two modes of operation of the carrier: as it is being carried, and while held erect by the stand on a flat surface.

The safety requirement is addressed in the choice of materials and design techniques. No rigid members are used in any portion of the cover. With the exception of the polycarbonate rod, or similar support, which supports the head enclosure, the cover is constructed entirely of fabrics and traditional joining mechanisms such as zippers and hook and loop fastener. The selection of breathable fabrics and extensive use of mesh significantly reduces any risk of suffocation hazard, even when the cover is loose of the carrier. This is in contrast to some existing covers which utilize waterproof fabrics. The design utilizes curved edges and rounded corners to eliminate sharp angles and protrusions which could cause injury or snag on obstacles or branches.

Referring to FIGS. 5 and 6 it can be seen that a majority of the cover is constructed from a mesh material. Depending on the size and dimension of the cover, 80% to 90% of the surface area of the cover may be mesh. Panels 302, 320, and 318 surround the baby on three sides with mesh. Solid material is used only at wear and stress points and where sun protection is desired. Alternatively, these could also be constructed of mesh. In particular, the front corners, 322, may also be formed as a seam between two mesh panels, or panels 302 and 320 can be formed from a single continuous piece of fabric. The particular mesh used in the preferred embodiment has very small openings, up to 4000 per square inch, and high burst strength. The mesh used in the preferred embodiment scores 55–65 LB/in$^2$ in the Mullen D3847 burst strength test. The mesh itself is strong enough to small pieces of gravel as might be thrown up by a passing car. These characteristics provide a material which is impassable to the smallest insects, including "no-see-ums", tear resistant, capable of blocking flying debris, and which still provides almost unrestricted air flow. Although in the preferred embodiment the rear panel and stand pocket are constructed from a solid material, these panels could also be constructed from mesh material to provide increase air flow.

The pocket, 306, for the carrier's stand and the lower portion of the body, 326, are constructed of an opaque, waterproof, breathable fabric. In the preferred embodiment this is a Gore-tex® material. This further increases the overall breathability of the cover while blocking the intrusion of water and dirt. This also improves the durability of the cover as these portions of the cover will be subjected to the most wear and tear when the carrier is set on the ground. Panel, 324, which covers the hip pad on the carrier is also constructed of the same opaque material. This panel is subject to greater friction than most other panels as it is in constant contact with the parents hips while the carrier is being carried and the increased durability of the opaque material is needed. Further, this material provides a lower coefficient of friction relative to the mesh material, increasing comfort and reducing wear on the parent's clothing.

Figure 8A:
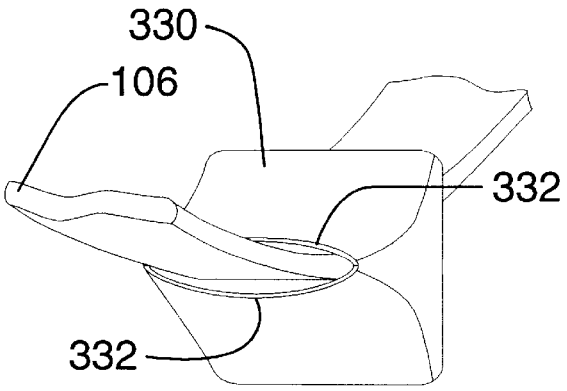
FIG. 8A provides a detailed view of the strap housing in the open position.
Figure 8B:
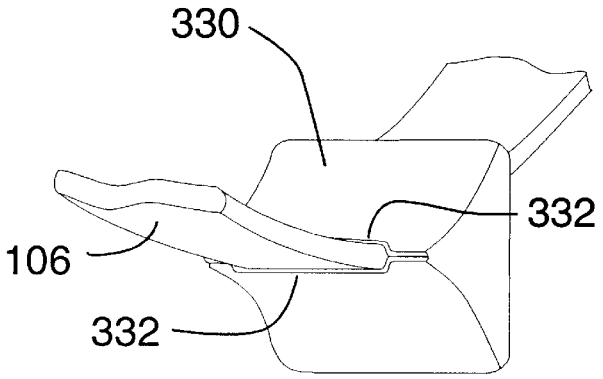
FIG. 8B provides a detailed view of the strap housing in the closed position.
Figure 9A:
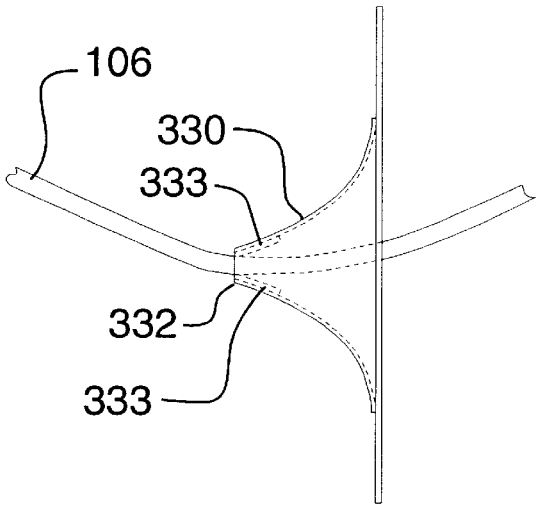
FIG. 9A provides a detailed side view of the strap housing in the open position.
Figure 9B:
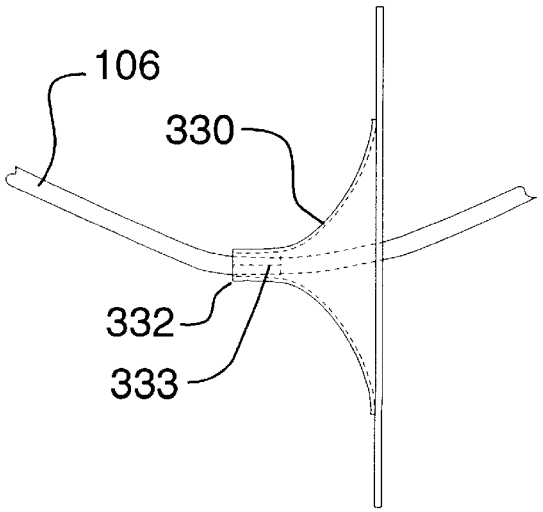
FIG. 9B provides a detailed side view of the strap housing in the closed position.

The openings, 308, 310, and 312, for the shoulder and waist straps are shown in detail in FIGS. 8 & 9. Each of these openings is similarly constructed and is generally represented by the opening illustrated. Protruding housing, 330, is formed from fabric or a similar flexible material. It is permanently attached to the body of the cover surrounding the slit through which the strap, 106 (or similarly 108) passes. The outermost edges, 332, of the housing form an essentially linear opening oriented to align with the flat strap. The inner surfaces of these edges are releasably joined by hook and loop fastener, 333, the hook portion on one surface and the loop portion on the facing surface. When the opening is not in use, the two surfaces are joined together, creating a seal which is nearly impassable to insects. When the opening is needed, the two surfaces are separated and the strap passed through, as shown in FIGS. 8A and 9A. After the strap is properly positioned, the edges of the housing are pinched together alongside the strap, sealing that portion of the opening and holding the portion of the opening through which the strap passes in close contact with the strap. Alternatively, the edges can be stiffened to improve the contact with the strap. The flexible nature of the housing, and its extension beyond the body of the cover, enables it to move with the straps as they shift position, reducing the likelihood that the seal will be broken. If desired, mating sections of hook and loop fastener can be affixed to the straps so that the edges of the housing can connect directly to the straps.

Figure 7:
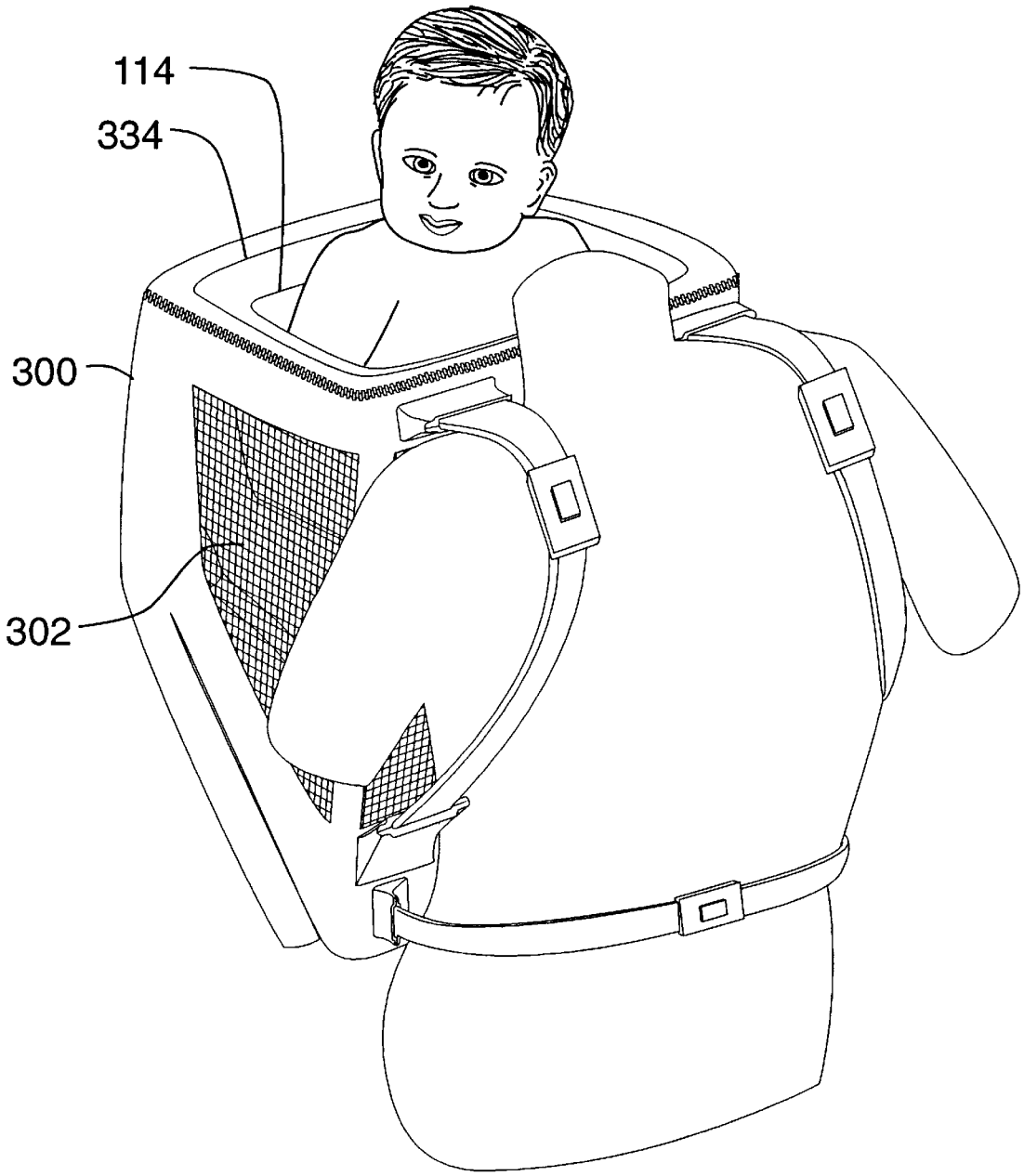
FIG. 7 shows the present inventive cover with the head enclosure collapsed.

Referring to FIG. 7, the head enclosure has been folded back to expose the top of the carrier. Opening, 334, in the body of the cover provides for insertion of the carrier into the cover and for placing the baby into the carrier with the cover in place. The opening is sufficiently large to allow passage of the carrier at its widest point. With the cover in place, the opening is then cinched to a smaller diameter to hold the cover in place. In the preferred embodiment, the cinching is achieved by use of a fixed elastic strap, sewn into the upper edges, which draws the edges inward. Alternatively an non-elastic draw cord can be used which is pulled and then fixed in position. A further alternative is to use elastic cord, commonly referred to as shock cord, which can be tensioned by pulling on it, similar to the draw cord, but which will then provide a resilient means, similar to the elastic strap, to continually pull the edges inward. The edges of the opening are configured such that when fully tightened, they are still positioned outward of the inner edge of the carrier seat, 114. This avoids unnecessary contact between the baby and the edge of the cover. While the baby may reach out and touch the cover, the design is such that the cover does not bear on the baby. Such contact would be irritating to the baby, possibly resulting in chafing, especially during hot weather. Reducing such contact improves the baby's experience while using the cover.

Referring again to FIGS. 5 & 6, the structure of the enclosure for the baby's head, 304, can be seen. The configuration of this enclosure is a unique feature of the cover. It is designed to maximize ventilation and visibility while providing sun and insect protection; blocking or deflecting light impacts; and being easily opened to provide access to the baby and to remove the cover from the carrier. Mesh panel, 318, wraps around both sides and the front of the head enclosure. This provides unobstructed viewing, both in and out, on three sides as well as flow through ventilation while excluding insects and wind-blown debris. The opaque panel, 316, extends over the top and back of the enclosure providing sun protection from behind and overhead. Alternatively, a mesh panel can be added behind the baby's head to increase front to back flow through ventilation.

Figure 10:
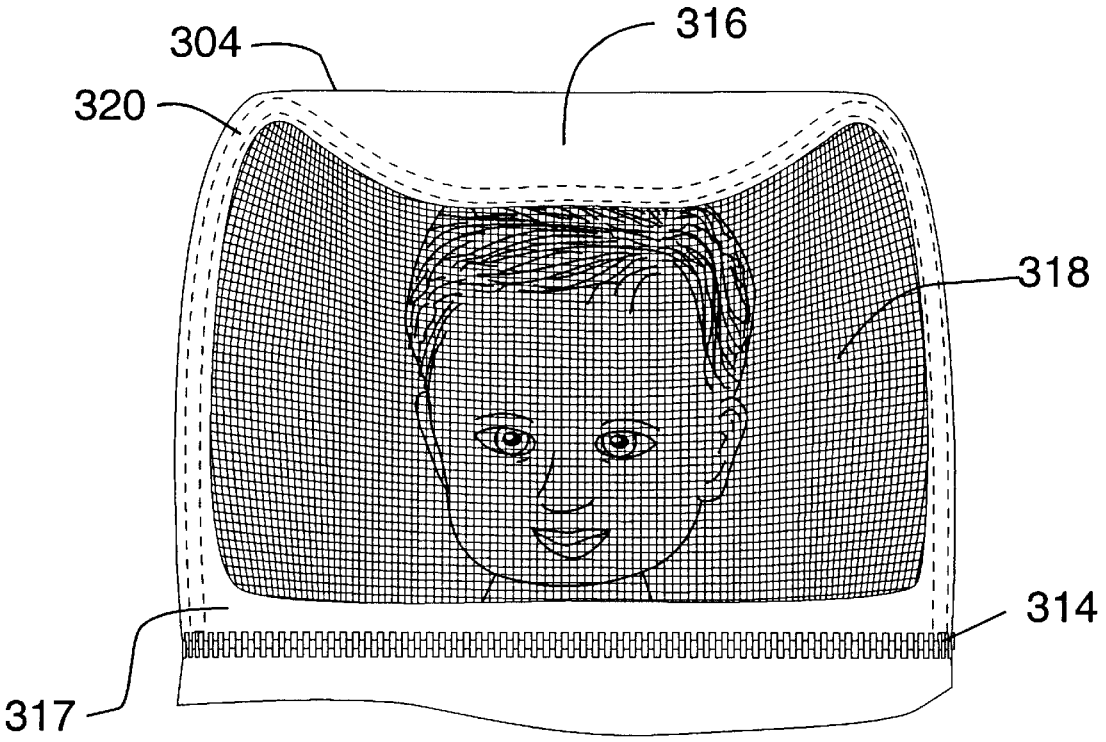
FIG. 10 provides a detailed front view of the preferred embodiment of the head enclosure.
Figure 11:
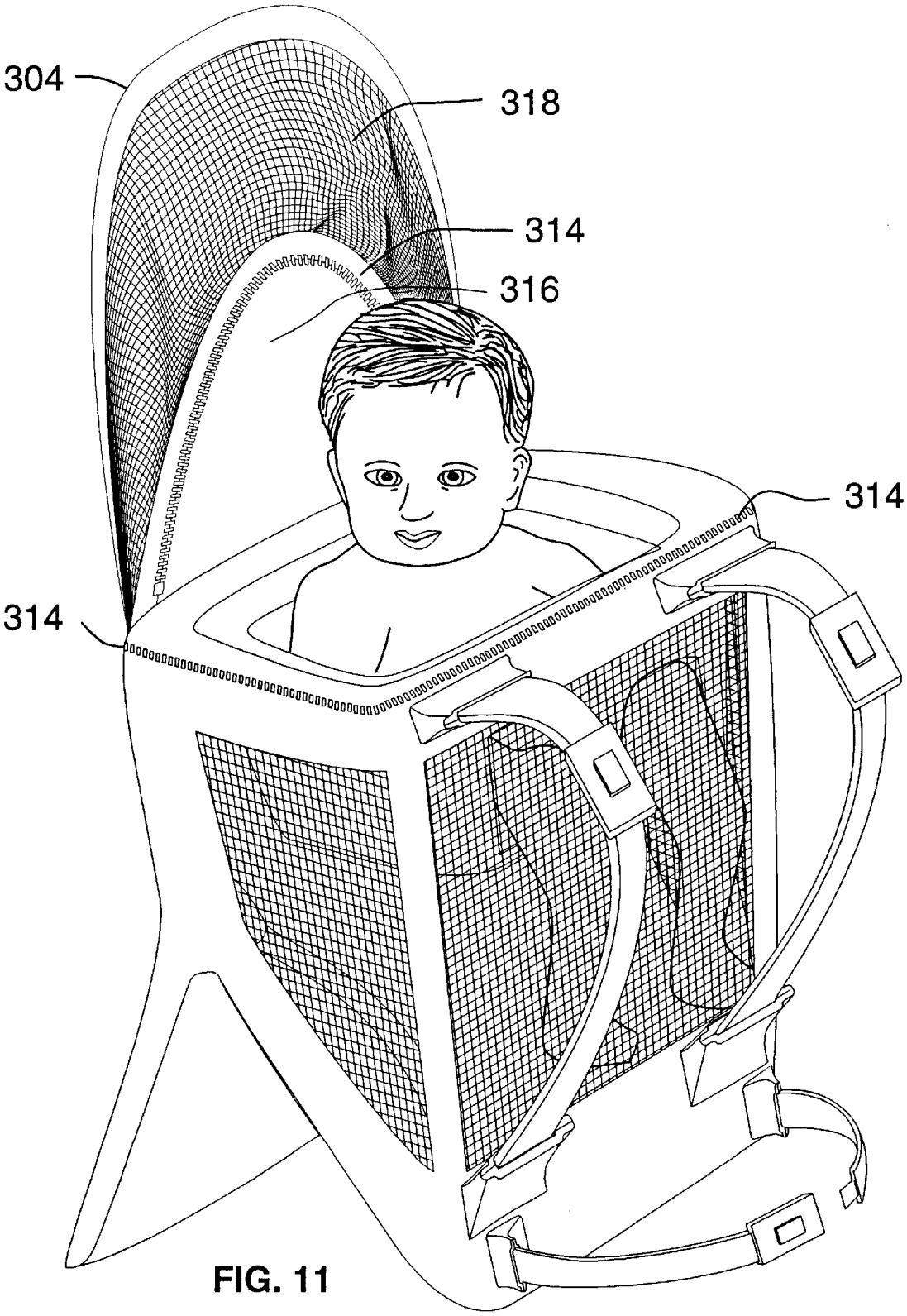
FIG. 11 illustrates the head enclosure in its open position where the support rod is attached to the rear of the body.
Figure 12:
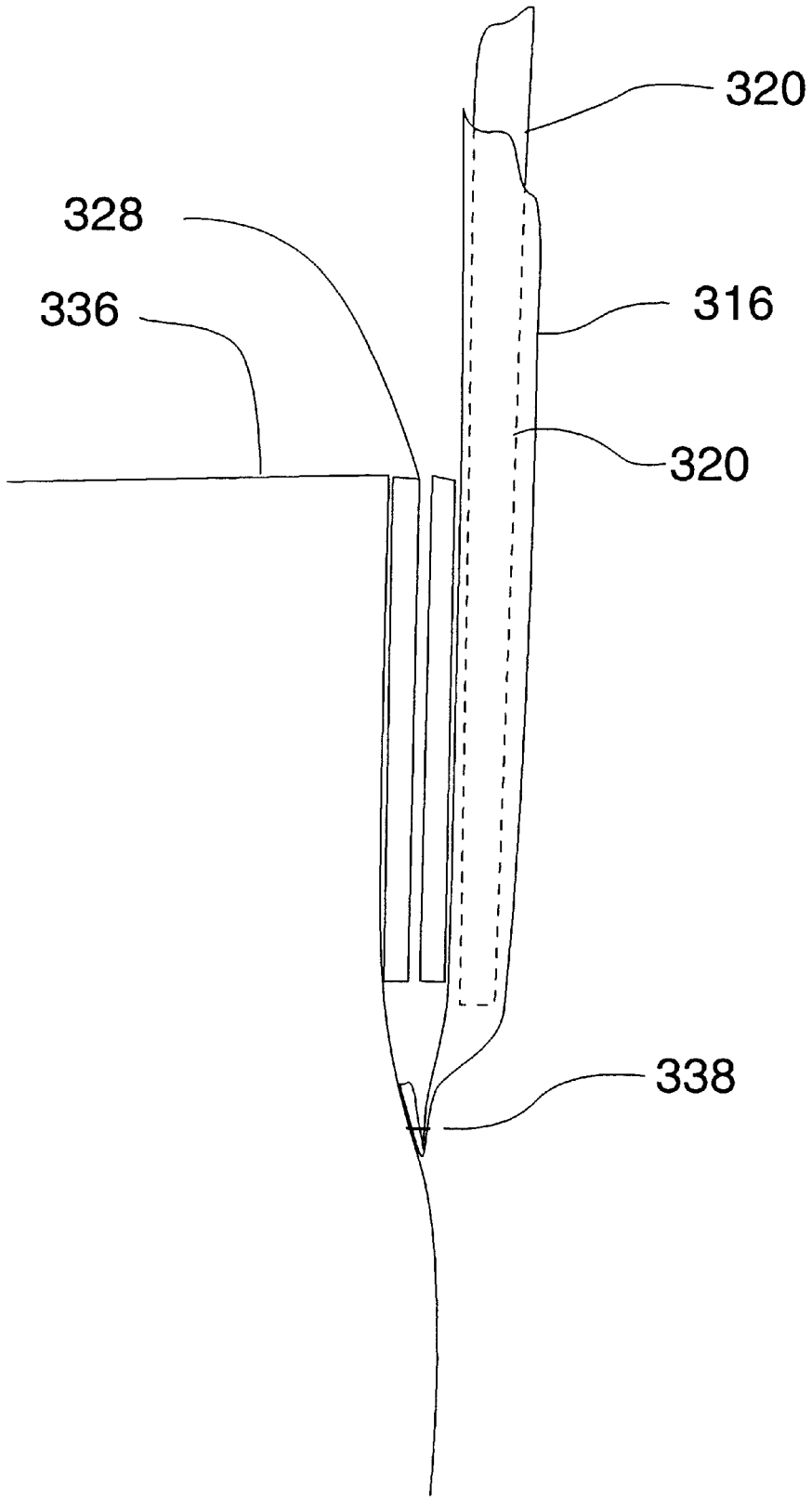
FIG. 12 provides a detailed view of the attachment of the rear corner of the head enclosure to the body of the cover.

The shape of the head enclosure, 304, is maintained by a resilient rod, 320 in FIG. 10, which is sewn into a pocket in the edge of the head enclosure. In the preferred embodiment, a continuous polycarbonate rod is used which attaches to the body of the cover at each end, as shown in FIG. 12, and discussed below. FIG. 11 shows the shape of the head enclosure when the rod ends are attached to the body of the cover and the zipper, 314, is open. The rod curves in one plane and holds the head enclosure upright and out of the way. The mesh panel, 318, lies flat against the opaque panel. This facilitates the insertion and removal of the baby from the carrier. When the zipper is closed, joining the head enclosure to the body of the cover, the rod is forced to curve in a second dimension, taking on the shape shown in FIGS. 5 & 6. The force exerted by the rod, attempting to return to its natural, straight, condition, provides an upward and outward tension on the head enclosure, serving to hold the fabric and mesh panels taut. The upward component of this force also keeps the enclosure off of the baby's head.

A detailed view of the attachment of the rod ends to the body of the cover is shown in FIG. 12. The lower, rear edge of the opaque panel, 316, is sewn to the body of the cover at seam 338. This seam extends transversely across the back of the cover. As discussed above, rod, 320, is enclosed in a pocket in the opaque panel. Hook and loop fastener, 328, is attached to the opaque panel adjacent to the end of the rod, and to the mating surface on the rear corner, 336, of the cover. When the cover is raised into the vertical position, the two halves of the hook and loop fastener mate, holding the head enclosure in the vertical position shown in FIG. 11. From this position, the enclosure can be bent forward, and zipped closed, without releasing the hook and loop fastener. If it is desired to use the cover without the head enclosure, the hook and loop fastener can be released and the enclosure folded back along seam, 338, to lie flat against the rear of the carrier. If the enclosure will be unused for a significant time, it can be inserted into a pocket formed in the rear panel of the cover.

Figure 18:
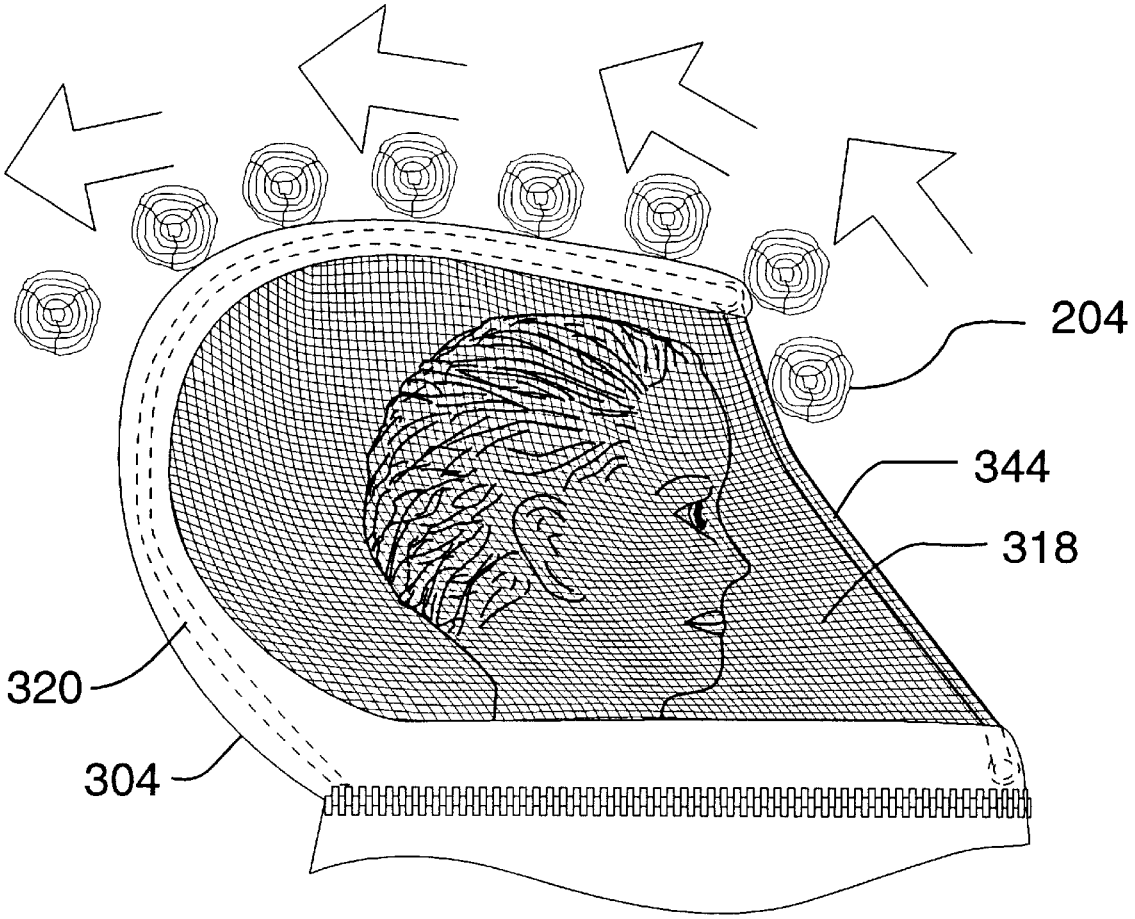
FIG. 18 illustrates the head enclosure deflecting a branch.

As shown in FIG. 18, the head enclosure also provides protection against light impacts as would occur when the cover strikes an overhanging branch, 204. The design of the head enclosure, 304, is such that an impact against the front of the mesh panel, 318, and/or the rod, 344, will push the panel rearward and downward. This, in turn, will pull the rod, 320, and the front edge of the opaque panel, 316, downward over the baby's head increasing the protection. Further, as the panel is pulled downward, it forms a sloping surface which angles upward, over the baby's head. This surface acts as a ramp which redirects the branch upward, clear of the baby's head. By deflecting the impact rather than resisting it, protection can be provided against a relatively greater force. The amount of force which can be deflected depends primarily on the amount of tension and upward force provided by the rod. This force can be altered by changing the stiffness of the rod and the initial curvature of the rod. Because of the high tensile strength of the mesh, it is not a limiting factor. Altering the initial slope of the rod and opaque panel will also increase the protection by increasing the initial slope available to deflect objects. Alternative approaches to increasing the amount of protection are discussed below.

Figure 13:
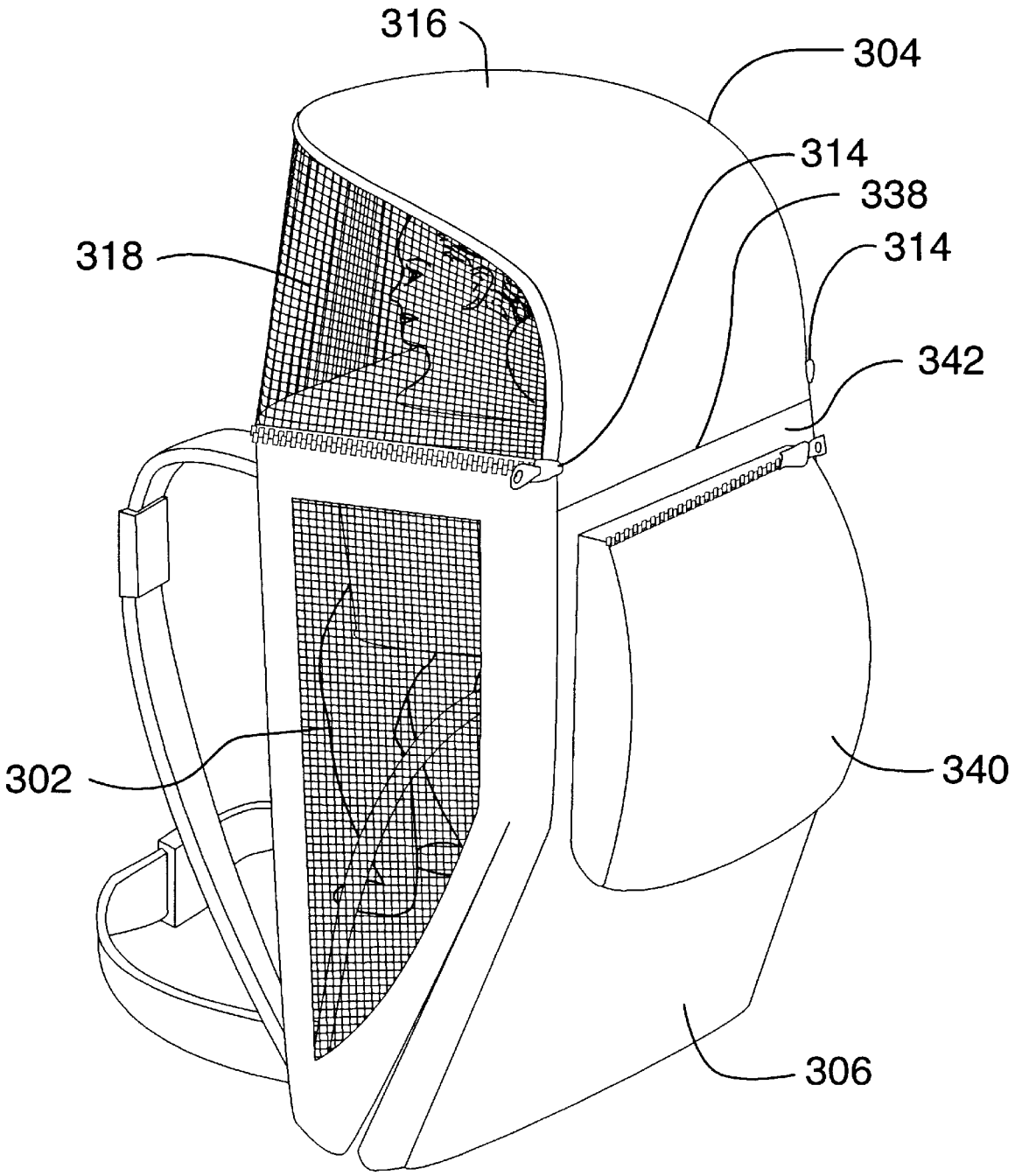
FIG. 13 provides a rear perspective view of the present inventive cover.

As FIG. 13 shows, the preferred embodiment also includes one or more pockets or pouches, 340, on the rear panel, 342, of the cover. These pockets provide storage for various items such as diapers, bottles, toys, etc. As discussed above, one of the pockets can also hold the head enclosure when it is folded back, not in use. Alternatively, the cover can also be self-storing by folding into one of the pockets when removed from the carrier.

As shown in FIGS. 6 and 13, the cover includes an integral pocket, 306, which encloses the baby carrier stand. The pocket extends outwardly from the main body of the cover and conforms closely to the outline of the stand. This design provides a continuous enclosure for the stand which moves with the stand as it pivots outwardly for deployment. In the preferred embodiment, opaque breathable material is used for the pocket and for the adjacent panel of the main body. This maximizes the strength and scuff resistance in these areas which are most exposed to wear and tear from contact with the ground and possibly underbrush when the carrier is set down. This material is also more resistant to intrusion of dirt and staining and is easier to clean than the mesh fabric. Alternatively, mesh panels could be used for the vertical portions of the pocket and the adjoining main body panel while using the opaque material for the lower edges which actually come into contact with the ground. While decreasing the resistance to soiling, this would further increase the available ventilation. Another alternative is to add a retainer to hold the stand pocket against the main body of the cover. This retainer would help hold the stand in position and keep the pocket from flapping when used with a carrier with no stand. Because of the configuration of the pocket, it can also be inverted and tucked inside the main body of the cover if it is not needed for a stand on the carrier.

Alternative Embodiments

Several alternative embodiments of the disclosed invention are anticipated. FIGS. 14 through 17 illustrate an adaptation of the head enclosure which increases the amount of impact protection provided. Vertical bar, 344, is added which interconnects the top panel, 316, of the head enclosure with the lower front edge, 317, of the enclosure. The bar passes directly in front of the baby's face, in position to intercept hazards before they contact the baby. Preferably, this rod would also be a polycarbonate material but this can be altered to adjust the desired strength and stiffness. If desired, a rigid rod can also be used. The preferred method of joining rod, 344, to the head enclosure is to use T couplings, 348 and 350. Coupling 348 attaches the upper end of the rod to the existing rod, 320, which supports the head enclosure. The connection of this coupling to rod, 320, is sufficiently free to allow rod, 320, to pivot. This allows the enclosure to collapse for storage. Coupling, 350, joins the lower end of the rod to new rod, 346, which is sewn into the lower front edge. If desired, this connection can be fixed to prevent rotation of coupling, 350, about rod, 346. This may be done by fixing rod, 346, to the fabric; by bracing the vertical portion of coupling, 350, against the fabric; or by extending the rod down the front of the body of the cover and attaching it to, or bracing it against the inside of, the fabric. By preventing the rotation of the coupling, the rigidity of the bar is increased because it must then flex in order to move backward when impacted. Clearly, other known methods of connecting the rod to the enclosure can also be used. Alternatively, the lower rod, 346, could be left unattached to the enclosure. By positioning the lower rod within the body of the enclosure, any impact would push the lower end of the rod forward, into contact with the enclosure, or or the carrier, which would then halt further movement.

Figure 14:
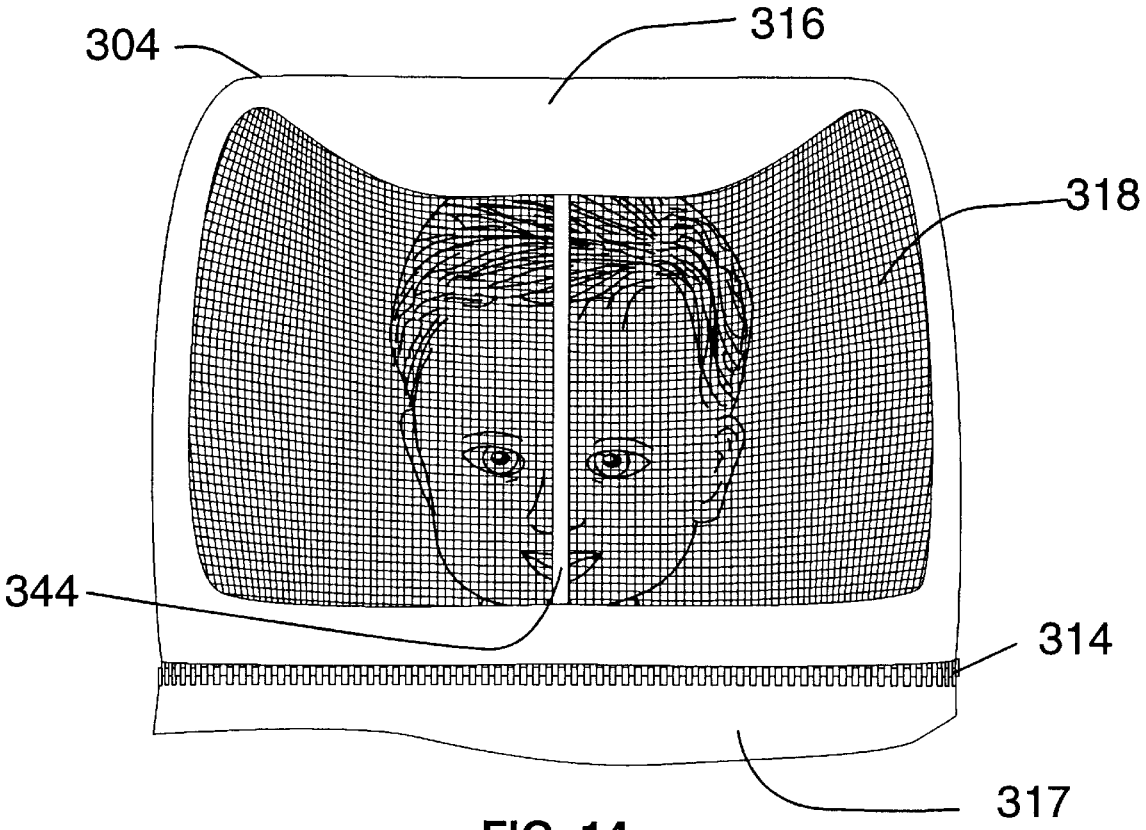
FIG. 14 provides a detailed view of an alternative embodiment of the head enclosure.
Figure 15:
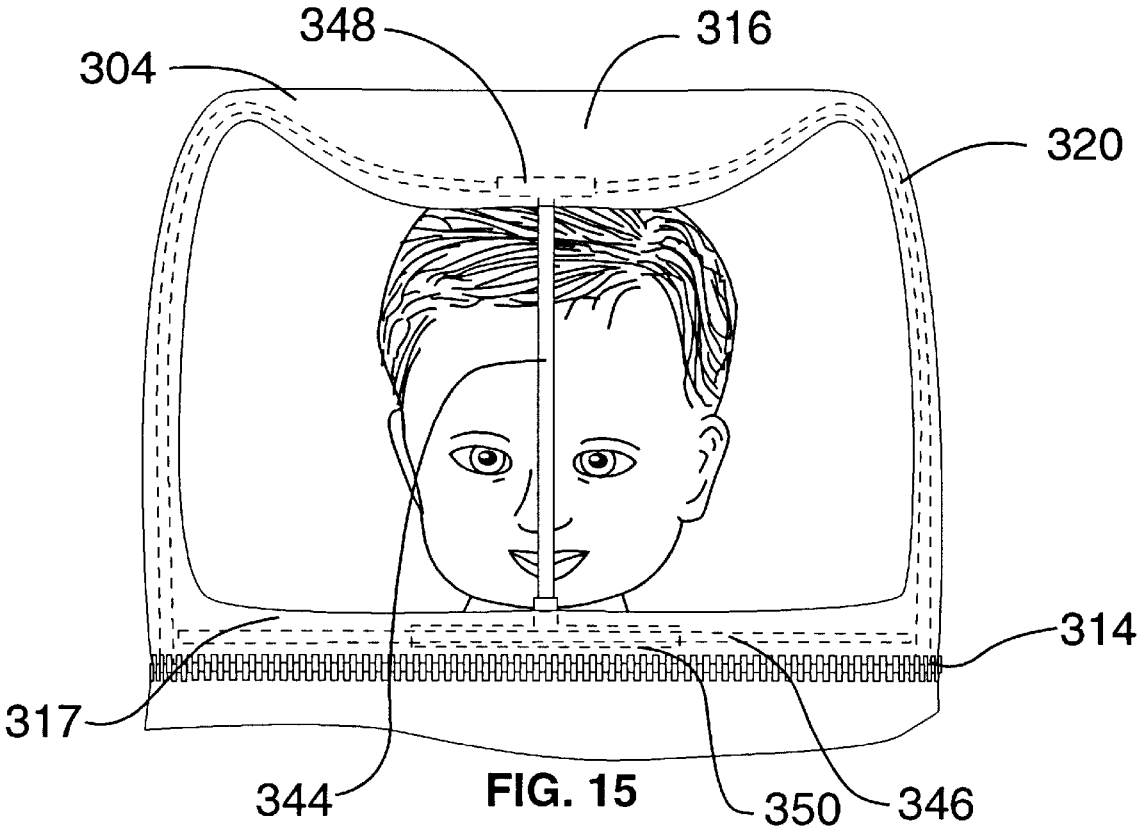
FIG. 15 provides a detailed front view of support rods used in the alternative embodiment for the head enclosure.
Figure 16:
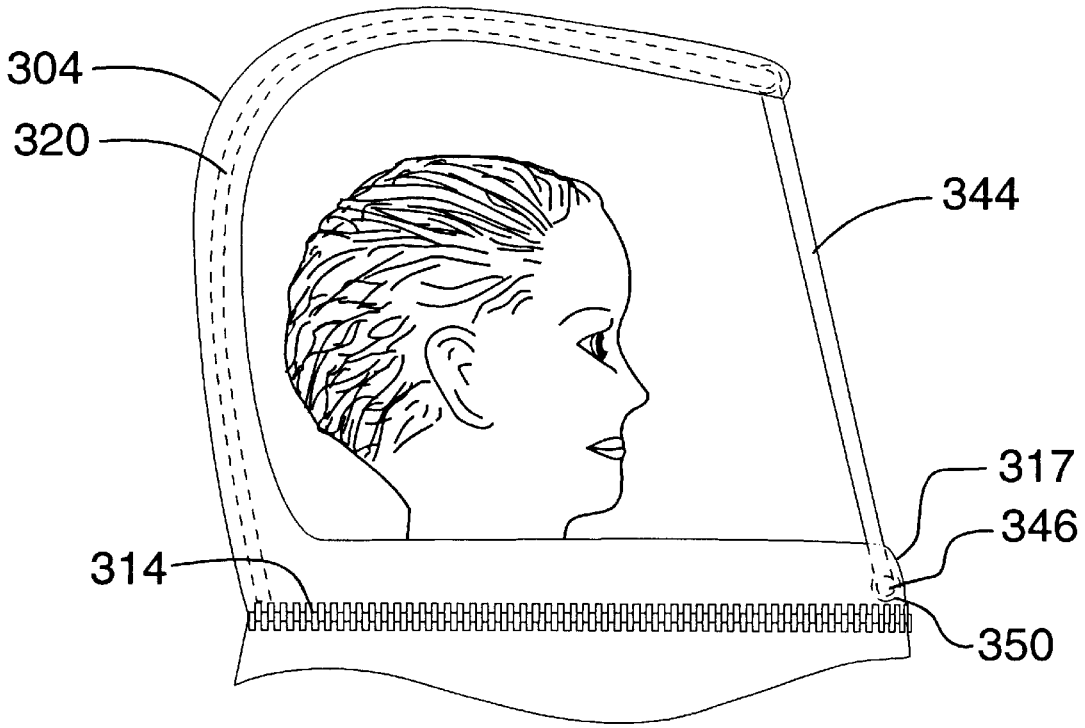
FIG. 16 provides a detailed side view of support rods used in the alternative embodiment for the head enclosure.
Figure 17:
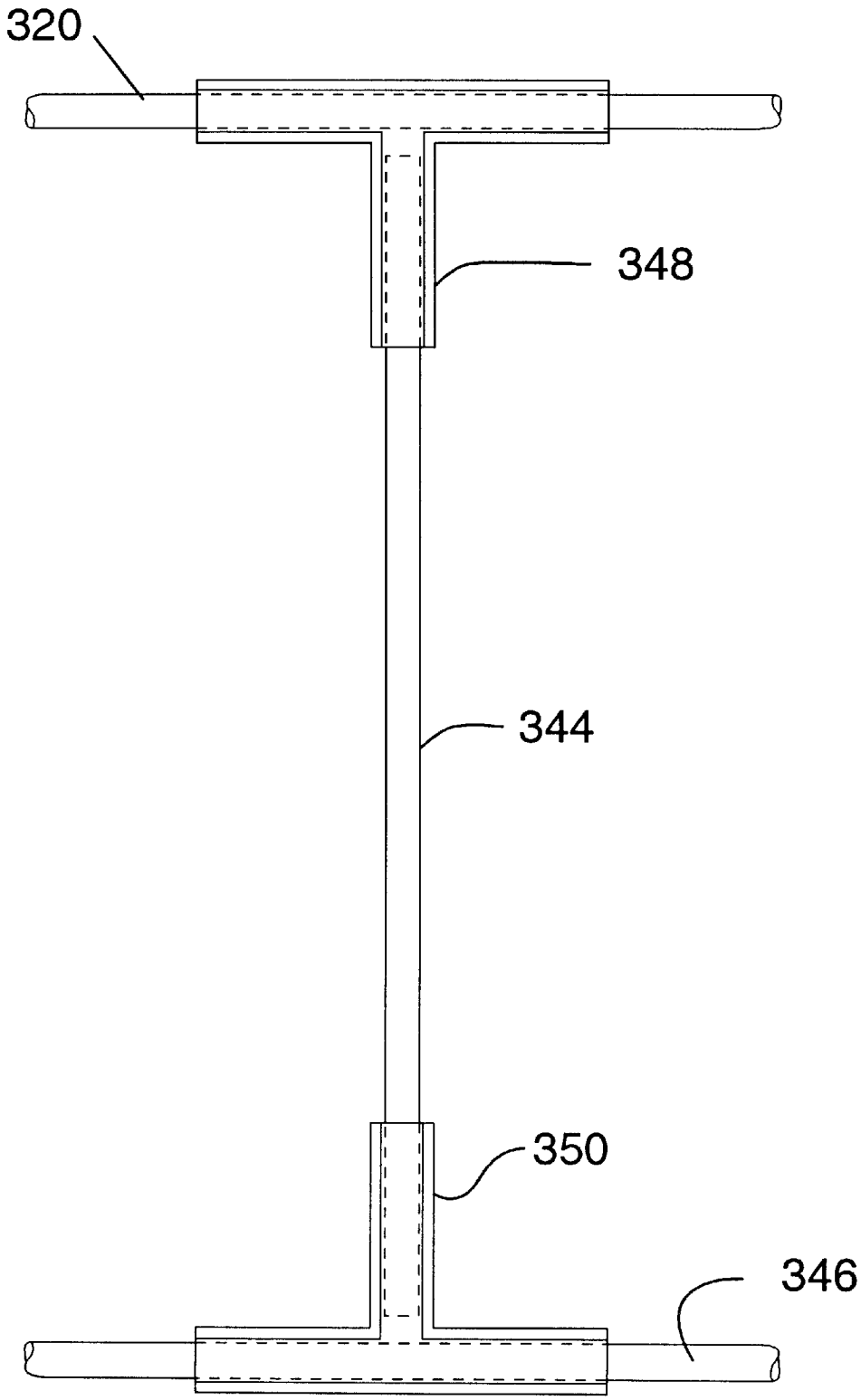
FIG. 17 provides a detailed view of the interconnection of the support rods in the alternative embodiment for the head enclosure.

As shown in FIG. 14, the additional bar, 344, may be used in combination with mesh panel 318. The bar may also be used without the mesh panel as shown in FIGS. 15 and 16. In this configuration, the bar assumes the role, usually served by the mesh panel, of supplying the downward force necessary to hold the rod, 320, and opaque panel, 316, in position. While not providing the insect protection of the normal configuration, this option does provide sun protection and impact protection against objects positioned laterally across the carrier.

Several alternatives exist for attaching the rod, 344, to the cover. It may be permanently or removably fixed to the lower front edge, 348, of the head enclosure, as illustrated. This arrangement is the simplest to use as the rod is attached and detached using the normal attachment mechanism for the head enclosure. However, if it is desired to use the head enclosure without the mesh panel, a separate mechanism must be supplied to detach the panel from the surrounding edges of the enclosure. Alternatively, the bar can be separately attached to the body of the cover. This allows the enclosure to be used without the mesh panel simply by releasing the zipper, 314, folding the panel under the top of the enclosure, behind the baby's head, and using the rod to hold the top panel, 316, of the enclosure in place. If desired a retaining mechanism, such as strap, can be added to retain the mesh panel in position underneath the top panel. While requiring two steps to secure the head enclosure, the overall process may be easier. First, the top panel is pulled forward and down and secured in position by attaching the rod to the front of the cover. Second the zipper is closed, sealing off the mesh panel. This step may be easier as the panel will be under significantly reduced tension as a result of being held in place by the rod.

A second alternative embodiment is to provide an additional panel, or panels, which can be draped over the mesh panel, 318, of the head enclosure for increased sun, rain, and snow protection. The panel(s) may be permanently or removably fixed to the opaque panel, 316. When not needed, the panel will be folded back to lie along the top of the enclosure, or detached. When needed, it will be flipped down to cover all or a portion of the mesh panel. Optionally, a pocket attached to panel, 316, could be added to store the additional panel. Where removable fasteners are used, a panel which is smaller than the complete span of the mesh panel can be used. The position of the panel can then be adjusted as needed to block off only that portion of the mesh panel through which sun is entering. A similar approach can be applied to the panels in the body of the cover. If desired, multiple panels can be attached to increase the protected area or to shield more than one mesh panel. By providing the added panel with fasteners along the bottom, it can also serve as a wind barrier to protect the baby from wind. A further alternative would be to utilize mesh for all panels of the head enclosure, providing maximum ventilation. A supplemental opaque panel could then be attached via removable fasteners as, and where, needed for sun protection.

Another alternative embodiment is to add a baffle to the ends of the zipper, 314, which hold the head enclosure in place. With some zipper designs, when the zipper is closed a small gap may be left open at the end of the zipper through which small crawling insects may enter. An additional flap over the end of the zipper would block this gap. The flap would be secured by hook and loop fastener or other conventional fasteners.

A further alternative is to add a printed pattern to the mesh material. This allows the mesh to better contribute to the color scheme and appearance of the cover. While primarily for aesthetic purposes, the addition of the pattern to the mesh may also increase the amount of sun protection provided by the mesh as well as either increasing the amount of privacy provided or improving visibility into the cover. Certain pattern and color combinations make it very difficult to see through the mesh, offering increased privacy. Other pattern and color combinations actually make it easier to see through the mesh, making it easier to monitor the baby.

Another alternative embodiment is to impregnate the mesh panel with a nontoxic insect repellent. This treatment may be provided during the manufacture of the material or during the manufacture of the cover and could be supplemented by the end user of the cover. This treatment offers the advantage of repelling insects which land on, or crawl onto the cover. By repelling the insects, the amount of time they will have to locate any gaps or openings in the cover will be significantly reduced. Further, they will not remain on the surface of the mesh, possibly becoming an irritant to the baby. The opaque material may also be similarly treated if desired.

While the preferred form of the invention has been disclosed above, alternative methods of practicing the invention are readily apparent to the skilled practitioner. The above description of the preferred embodiment is intended to be illustrative only and not to limit the scope of the invention.

What is claimed is:

1. A protective enclosure for a baby carrier holding an occupant comprising:

(a) a body cover comprising at least a portion of insect resistant mesh, having an open end, said body cover adapted to enclose at least a lower portion of the carrier;

(b) means for securing said open end around the baby carrier;

(c) a head cover comprising at least a portion of insect resistant mesh, adapted to cover the head of the occupant; and (d) means for securing said head cover to said body cover.

2. The protective enclosure of claim 1 wherein said porosity is at least 1200 openings per square inch.

3. The protective enclosure of claim 1 wherein said mesh comprises at least 40 pounds per square inch burst strength.

4. The protective enclosure of claim 1 wherein said mesh comprises a diffusing mesh to reduce the intensity of inclement weather within said protective enclosure.

5. The protective enclosure of claim 1 wherein said mesh portion of said head cover comprises at least 95% of the surface area of said head cover.

6. The protective enclosure of claim 5 further comprising a sunshade which is removably attached to said head cover.

7. The protective enclosure of claim 1 wherein said means for securing said open end around the baby carrier does not urge said body cover into contact with the occupant.

8. The protective enclosure of claim 1 wherein said head cover further comprises means to support said head cover out of contact with the occupant's head.

9. The protective enclosure of claim 8 wherein said support means comprises a resilient rod.

10. The protective enclosure of claim 8 wherein said head cover has an upper panel having outer edges and said support means comprises a single, arcuate resilient rod fixed at both ends to said enclosure and attached to said outer edges of said upper panel.

11. The protective enclosure of claim 1 wherein at least a portion of said mesh is imprinted with one or more colors, whereby visibility into said enclosure is altered.

12. The protective enclosure of claim 1 wherein at least a portion of said mesh is treated with an insect repellent.

13. A protective enclosure for a baby carrier holding an occupant comprising:

(a) a body cover adapted to enclose at least a lower portion of the carrier;

(b) a head cover comprising at least a portion of insect resistant mesh, adapted to cover the head of the occupant; and (c) means for securing said head cover to said body cover;

whereby said protective enclosure fully encloses the baby carrier and the occupant.

14. The protective enclosure of claim 13 wherein the baby carrier includes at least one carrying strap, said enclosure further comprising plural openings in said body cover adapted to receive the carrying strap, each of said openings comprising a baffle designed to impede the entry of small insects.

15. The protective enclosure of claim 14 wherein each of said baffles comprises a hook and loop fastener adapted to hold said corresponding opening in close contact with the carrying strap.

16. The protective enclosure of claim 13 wherein said porosity is at least 1200 openings per square inch.

17. The protective enclosure of claim 13 wherein said means for securing said head cover to said body cover comprises a seal which prevents the entry of small insects into said protective enclosure through said means for securing.

18. The protective enclosure of claim 17 wherein said seal comprises a hook and loop fastener.

19. The protective enclosure of claim 17 wherein said seal comprises a zipper.

20. The protective enclosure of claim 19 further comprising a baffle adjacent to at least one end of said zipper which prevents the entry of small insects at the end of the zipper.

21. The protective enclosure of claim 13 wherein said head cover is adapted to fold into position substantially parallel to one side of said body cover when not in use.

22. The protective enclosure of claim 13 wherein said head cover further comprises resilient support means to support said head cover out of contact with the occupant's head.

23. The protective enclosure of claim 22 wherein said head cover has an upper panel having outer edges and said support means comprises a single arcuate rod fixed at both ends to said enclosure and attached to said outer edges of said upper panel.

24. The protective enclosure of claim 22 further comprising an impact guard attached to said support means.

25. The protective enclosure of claim 24 wherein said impact guard is pivotally attached to said support means.

26. The protective enclosure of claim 13 wherein said body cover comprises a lower panel which is impermeable to liquid water and permeable to water vapor.

27. A protective enclosure for a baby carrier holding an occupant, the baby carrier including a stand for supporting the carrier, comprising:

(a) a body cover adapted to enclose at least a lower portion of the carrier;

(b) a head cover comprising at least a portion of insect resistant mesh, adapted to cover the head of the occupant;

(c) means for securing said head cover to said body cover; and (d) a stand cover, communicating with said body cover, adapted to receive the support stand.

28. The protective enclosure of claim 27 wherein said body cover comprises a lower panel and said stand cover comprises a lower panel, each of said lower panels designed to make contact with the ground when the stand is supporting the carrier and each of said panels impermeable to liquid water and permeable to water vapor.

29. The protective enclosure of claim 27 wherein said porosity is at least 1200 openings per square inch.

30. The protective enclosure of claim 27 wherein said head cover further comprises resilient support means to support said head cover out of contact with the occupant's head.

31. The protective enclosure of claim 30 wherein said head cover has an upper panel having outer edges and said support means comprises a single arcuate rod fixed at both ends to said enclosure and attached to said outer edges of said upper panel.

32. The protective enclosure of claim 30 further comprising an impact guard attached to said support means.

33. A protective enclosure for a baby carrier, with carrying straps and a stand for supporting the carrier, holding an occupant, comprising:

(a) a body cover comprising at least 50% insect resistant mesh, said body cover having an open end, said body cover adapted to enclose at least a lower portion of the carrier;

(b) means for securing said open end around the baby carrier which does not urge said body cover into contact with the occupant;

(c) plural openings in said body cover adapted to receive the carrying straps, each of said openings comprising a baffle designed to impede the entry of small insects;

(d) a bead cover comprising at least 50% insect resistant mesh and a resilient support means to hold said head cover substantially away from the occupant, adapted to cover the head of the occupant;

(e) means for securing said head cover to said body cover comprising a seal which prevents the entry of small insects into said protective enclosure through said means for securing; and (f) a stand cover, communicating with said body cover, adapted to receive the support stand;

whereby said protective enclosure fully encloses the baby carrier and the occupant.

34. The protective enclosure of claim 33 wherein said head cover comprises:

(a) a single continuous opaque panel which forms the rear and top of said head cover, said opaque panel having a single continuous outer edge;

(b) a single continuous mesh panel which forms the front and two sides of said head cover, said mesh panel having a continuous edge which includes the upper edge and the ends of both sides;

wherein said continuous outer edge of said opaque panel is joined to said continuous edge of said mesh panel, and wherein said resilient support means comprises a single, arcuate resilient rod fixed at both ends to said enclosure and attached to said continuous outer edge of said opaque panel.

35. The protective enclosure of claim 34 further comprising an impact guard pivotally attached at a first end to said single arcuate rod and attached at a second, opposite, end to said head cover.

36. The protective enclosure of claim 34 further comprising a pocket attached to said body cover and wherein said head cover is adapted to fold into said pocket while said body cover is in place on the carrier, and wherein said body cover and said head cover are adapted to fold into said pocket when removed from the carrier.

37. The protective enclosure of claim 34 further comprising a sunshade, removably attached to said enclosure, which can be positioned to block sunlight from reaching at least one of said mesh panels.

* * * * *